US005494200A

United States Patent [19]

Sheffler et al.

[11] Patent Number: 5,494,200

[45] Date of Patent: Feb. 27, 1996

[54] CLOSURE AND SIFTER ASSEMBLAGE HAVING AUTOMATICALLY RELEASABLE, INTERLOCKING BEAD RETAINER STRUCTURES

[75] Inventors: Robert Sheffler, Morganville; Thomas Dolan, Flemington, both of N.J.

[73] Assignee: Brent River Packaging Corporation, Flemington, N.J.

[21] Appl. No.: 278,829

[22] Filed: Jul. 22, 1994

Related U.S. Application Data

[63] Continuation-in-part of Ser. No. 18,232, Feb. 16, 1993, abandoned.

[51] Int. Cl.[6] ..... A47G 19/24

[52] U.S. Cl. ..... 222/565; 222/570; 220/256; 215/227

[58] Field of Search ..... 222/478, 480, 222/545, 560, 570, 189.02, 565; 220/256; 215/227, 273, 277

[56] References Cited

U.S. PATENT DOCUMENTS

| | | | |
|---|---|---|---|
| 2,576,416 | 11/1951 | Randlett | 222/565 X |
| 2,614,734 | 10/1952 | Slyk | 222/565 X |
| 2,645,382 | 7/1953 | Plough | 222/565 X |
| 2,729,363 | 1/1956 | Bauer et al. | 222/459 X |
| 3,031,107 | 4/1962 | Lococo | 222/459 X |
| 3,276,642 | 10/1966 | Johnson, Jr. et al. | 222/565 X |
| 3,388,841 | 6/1968 | McHardy et al. | 222/565 X |
| 3,512,681 | 5/1970 | Frankel | 222/158 |
| 4,066,181 | 1/1978 | Robinson et al. | 215/277 X |
| 4,498,608 | 2/1985 | Mercil | 222/142.5 |
| 4,961,521 | 10/1990 | Eckman | 222/545 X |
| 5,086,952 | 2/1992 | Kryk | 222/189.02 X |
| 5,183,171 | 2/1993 | Pherigo | 220/256 |

FOREIGN PATENT DOCUMENTS 1024178 3/1966 United Kingdom .

*Primary Examiner*—Gregory L. Huson
*Attorney, Agent, or Firm*—H. Gibner Lehmann; K. Gibner Lehmann

[57] ABSTRACT

A container for siftable products such as powders, solid particulates, spices, condiments and the like, comprises a bottle having a threaded neck, a screw cap for the bottle, and a sifter member disposed in the cap. The cap and sifter member are yieldably held together to constitute an assemblage which is applied to the bottle after the latter has been filled. The applying of the cap to the bottle forces the sifter to be transferred to and firmly secured on the bottle neck by cooperable configurations thereon, which provide a more aggressive grip or securement than the hold of the cap on the sifter. In consequence, whenever thereafter the cap is removed from the bottle, the sifter will remain operatively secured to the bottle to carry out its function.

11 Claims, 1 Drawing Sheet

CLOSURE AND SIFTER ASSEMBLAGE HAVING AUTOMATICALLY RELEASABLE, INTERLOCKING BEAD RETAINER STRUCTURES

CROSS REFERENCES TO RELATED APPLICATIONS

1. The present application is a continuation-in-part of our U.S. application Ser. No. 08/018,232 filed Feb. 16, 1993, entitled CLOSURE AND SIFTER ASSEMBLAGE, and having common ownership with the present application now abandoned.

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to closures for containers of the type having a sifter disk secured in place at the lip of the container and as typically employed for dispensing small or controlled amounts of various spices by means of a shaking motion imparted to the container while it is inverted.

2. Description of the Related Art Including Information Disclosed Under 37 CFR §§1.97–1.99

The following U.S. patents are hereby cited as being of interest in the field to which this invention pertains.

| U.S. Pat. Nos.: | | |
|---|---|---|
| 2,614,734 | 2,645,382 | 2,729,363 |
| 3,031,107 | 3,512,681 | 4,498,608 |
| 4,961,521 | 5,086,952 | |

In addition, the following references are cited as a consequence of their having been made of record during the prosecution of applicants' co-pending application Ser. No. 08/018,232 identified above:

| U.S. Pat. Nos.: | | |
|---|---|---|
| 2,576,416 | 3,276,642 | 3,388,841 |
| 5,183,171 | 4,066,181 | |
| British Patent No. 1,024,178 | | |

In U.S. Pat. No. 4,498,608, FIGS. 1 and 2 disclose a dispenser for condiments, comprising a container having a perforated "sifter" disk which is retained by pressing it in place on the container lip, in combination with a second disk which is perforated and which is adapted to be snapped into the closure for the container, and which together with the closure forms a chamber in which absorbent material is placed. In use the second disk remains with the closure, whereas the first disk remains with the container. Grains of rice in the chamber function to absorb undesirable moisture from the condiment during storage, for example.

U.S. Pat. No. 2,645,382 discloses a dispenser having a container and a sifter disk clamped between two rings (20, 22) and against the lip of the container, by means of a removable threaded sleeve (10). The sleeve is applied to the container after the closure (presumably not shown) has been removed. The sleeve and sifter disk are removed at such time as the closure is to be reapplied, as presently understood.

U.S. Pat. No. 4,961,521 discloses a combination storage and metering dispenser employing a variable-volume metering chamber having a sifter disk at one end, and a removable snap-on closure member or cap (22) covering the sifter disk. A predetermined quantity of granular or other material is first discharged into the metering chamber (29), after which the measured quantity can be discharged through openings (30) in a perforated end cap or member (19) of the chamber.

U.S. Pat. No. 3,512,681 illustrates another type of metering dispenser for particulate material, employing a storage canister (4) and a removable transparent container (16) which functions as a metering container. The latter has measuring indicia on its side wall, and a perforated end, FIG. 2. A closure cap (24) is receivable on the end. Dispensing is accomplished by first filling the metering container with the desired amount of material, and thereafter shutting off communication between this chamber and the canister. The metered quantity of material is then discharged through the perforated end of the metering chamber.

U.S. Pat. Nos. 2,614,734; 3,031,107; and 2,729,363 illustrate various forms of containers having either perforated members or gratings of a configuration which is intended to pulverize or disintegrate lumps which may form in the product being discharged, and thereby minimize the tendency for clogging. Nos. '734 and '107 utilize gratings that have knife-like edges which are intended to come into contact with the product and thus break it up into small pieces. No. '363 discloses two embodiments, one employing a spiral spring to effect the break-up, and a second employing a grating constituted of a flat disk with elongated openings or slits, which allegedly pulverize the product during shaking of the container, so as to eliminate clogging due to lumps.

U.S. Pat. No. 5,086,952 illustrates and describes a dispenser having a perforated lid which is pressed into the mouth of a container, and tightly seated therein. A separate, removable cover (30) in the form of a screw cap seals the container for storage.

The various devices disclosed in the above identified patents do not appear to have enjoyed any significant success in the marketplace. One reason may have been the relative complexity of the various structures, and the necessity for special operations on the part of the consumer in order to properly operate and use the particular dispensers in their intended manners. Also, with separate sifter and closure components, there existed the possibility of the sifter/measuring parts becoming either lost or misplaced when the dispenser was not being used.

Finally, the problem of assembly of these dispensers in a cost-effective manner is not addressed in the prior art noted above.

In order to be competitive today, it has been customary to employ automated procedures for both the filling of dispensers, and the resultant capping thereof. Automated capping equipment is well known in the dispenser field. Prior designs which did not lend themselves to use with such equipment were not feasible from the standpoint of economy in manufacture and assembly, and thus were not suitable for adaptation to present day commercial use and sale.

In prior containers employing both a sifter member and a closure, where automated equipment was employed the procedures that were conventionally followed were to first fill the dispenser with the desired quantity of material (usually granular in nature, i.e. spices and the like), after which a sifter disk was installed over or onto the opening of the container. Following this, a screw cap closure could be applied.

One of the problems with this procedure was that it consisted of two separate operations, both involving filled containers. During such operations, extreme care had to be exercised in insuring that the placement of the sifter disk was correct and did not result in breakage (possibly leading to malfunction of the dispenser at the time the consumer first used it, and worse, possible introduction into the container of fragments of plastic/glass resulting from shearing of either the disk or container.)

After the sifter disk was assembled to the container, there thus arose a need for an intermediate inspection step of some type, performed either visually by an operator, or by means of an automatic sensor, adapted to determine proper seating of the disk, prior to application of the closure.

Assuming that the disk was assembled in its intended manner and without breakage, the screw caps constituting the closures could then be applied in a second step, again usually employing automatic capping equipment.

With the procedure set forth in the immediately preceding paragraphs, there sometimes arose problems in achieving proper seating of the disk and/or closure cap. For example, if the disk were to be improperly seated, successful application of the closure cap could not be carried out.

SUMMARY OF THE INVENTION

Accordingly it is an object of the present invention to provide a novel and improved closure and sifter assemblage for a container, which obviates the problems mentioned, and which is both simple in its structure and reliable over extended periods of use.

A further object of the invention is to provide an improved resilient plastic screw cap and sifter assemblage that is held together by interlock retention, which after being applied to the container will be acted on by the container to experience a relaxing of the interlock retention so as to release only the cap at such times that the cap is unscrewed from the container.

Another object of the invention is to provide an improved closure and sifter assemblage as above, wherein the sifter or sifter member, when applied to the container, is stretched, including being stretched at its periphery as a consequence of the container lip being just slightly larger than the dimension of a lower bead on the sifter member. This stretching reduces or diminishes the retentive force between a second, or interlocking bead on the sifter and a cooperable interlocking bead on the screw cap, thereby facilitating by-pass of these interlocking beads. There results easier separation of the screw cap from the assembled sifter member and container. In effect, the stretched sifter member on the container is more inclined to "let go of" the screw cap after the sifter member is mounted in its final position on the relatively larger container lip. The arrangement is such that there is reduced the possibility of the sifter member being inadvertently lifted off with the screw cap when the latter is subsequently removed from the container. The improved retention of the sifter member on the container as occasioned by the weakened retentive force between the screw cap and sifter member when the latter is in place on the container lip, is considered to be an important feature of the present invention.

A related object of the invention is to provide a combined closure and sifter assemblage as outlined above, which is easy for the consumer to use, requires no special knowledge on his part, and which avoids the necessity of his reading instructions, since the operation is essentially completely self-explanatory or self-evident.

Still another object of the invention is to provide an improved combined closure and sifter assemblage in accordance with the foregoing, which lends itself to fabrication by means of automated capping equipment, and which greatly minimizes the possibility of inadvertent jamming and resultant malfunction of the finished dispenser that incorporates the assemblage.

Yet another object of the invention is to provide an improved combined closure and sifter assemblage of the kind indicated, which employs an absolute minimum number of separate pieces, thereby rendering it economical to fabricate and assemble, and thus making it cost-effective, and competitive in the market place.

An additional object of the invention is to provide an improved combined closure and sifter assemblage in accordance with the foregoing, which can be essentially completely molded in relatively simple plastic molds, and used with containers constituted of either glass or plastic, substantially without modification.

Another object of the invention is to provide an improved combined closure and sifter assemblage as above characterized, which provides an effective seal during storage and shipping, thereby avoiding inadvertent contamination of the contents.

A still further object of the invention is to provide an improved closure and sifter assemblage as outlined above, wherein with each re-application of the closure, the sifter mechanism is firmly engaged and forcibly urged into its proper seating on the lip of the container, thus re-inforcing a continued integrity of the assembled dispenser over extended periods of use.

Yet another object of the invention is to provide an improved method for producing a dispensing container which is especially adapted for use with automated capping equipment, and which substantially reduces the requirement for multiple inspections during the automatic assembly, thereby improving the efficiency of the manufacturing process while simultaneously reducing the cost.

The above objects are accomplished by a closure and sifter assemblage for use with a container having a lip with an external undercut, comprising in combination a screw cap having a threaded skirt and a closure wall spanning the skirt, and transferrable sifter means in the screw cap, comprising a sifter member having a central apertured portion spanning the skirt of the screw cap. The sifter member comprises a peripheral annular band-like rim having upper and lower back-to-back resilient and yieldable annular attachment beads. The closure wall of the screw cap has an integrally molded radially outwardly extending or flared annular bead disposed adjacent to and lying radially inwardly of the skirt of the cap. The upper bead of the sifter member, when the latter is assembled to the screw cap, resiliently and releasably interlocks with an interference fit, to the annular bead of the screw cap, and the lower attachment bead of the sifter member is frictionally engageable with the external undercut in the lip of the container when the screw cap and sifter member are screwed onto the container. The container lip tends to effect a radially outward stretching of the band-like rim of the sifter member and a corresponding radially outward stretching of the upper yieldable attachment bead thereof, thereby to reduce the interference fit existing between the upper attachment bead of the sifter member and the bead of the screw cap so as to facilitate by-pass of these beads when the screw cap is removed. The end result is that the sifter member is left in position on the lip of the container after complete removal of the screw cap from the container.

A significant feature of the invention is the novel retention of the sifter member or disk by the screw cap, which retention is substantially firm enough so as to withstand the rigors of tumbling in a capping machine hopper, with little or no likelihood of inadvertent dislodgement from the cap prior to the cap being installed on the container for the first time.

Other features and advantages will hereinafter appear.

DESCRIPTION OF THE PREFERRED EMBODIMENT

The particular enhancement provided by the present invention concerns the ability of a processor and packager to apply a sifter/closure in the form of a unitary assemblage and in a single operation, to a container to maintain an effective seal for the same and to protect the contents thereof.

Figure 2:
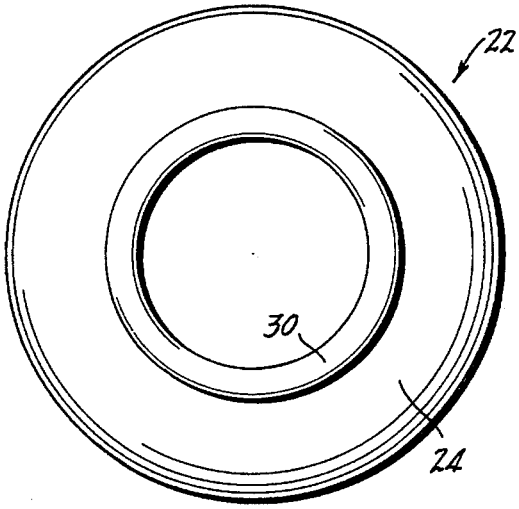
FIG. 2 is a top plan view of the container means of FIG. 1.
Figure 1:
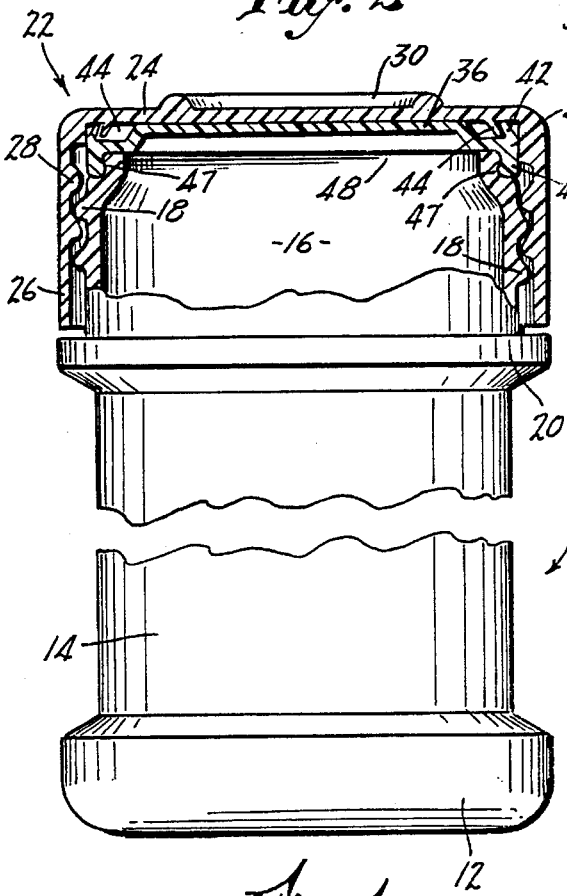
FIG. 1 is a fragmentary enlarged view partly in side elevation and partly in vertical section, of an improved container for a siftable product, as provided by the invention.

Referring first to FIGS. 1 and 2, the improved container comprises a bottle or container part 10 of plastic, glass or the like, which is shown as having an enlarged base portion 12, a main body portion 14 and an externally threaded neck portion 16 illustrated as having screw threads 18. Intermediate the body portion 14 and the neck portion 16 an external annular shoulder 20 is provided. The bottle part 10 can be most advantageously blow-molded from a rigid polyolefin, although glass or other suitable materials could be used.

Adapted to be screwed onto the neck portion 16 of the bottle 10 is a cup-shaped screw cap 22 of resilient plastic, having a circular closure wall 24 and, depending from the wall 24 an annular internally threaded skirt 26 having screw threads 28 adapted to mate with the threads 18 of the bottle neck 16. The screw cap 22 can have a circular strengthening rib 30 which also serves as ornamentation. The cap 22 could be injection molded of resilient polypropylene which has good compatibility, good relative rigidity and low cost. However, numerous other resilient thermoplastics would satisfy the same function. The continuous thread 28 of the cap 22 enables it to be readily torqued onto the container or bottle 10.

In accordance with the present invention a unique structural combination is provided, involving the cap 22, container or bottle 10 and an interposed molded resilient plastic transferrable sifter means comprising a sifter member 32 now to be described, which can be advantageously molded from low or medium density resilient polyethylene or similar resilient plastic that is compatible with the product to be sifted. The sifter member 32 is initially interlockingly carried by the screw cap 22 prior to application of the latter to the bottle 10, and is thereafter automatically transferred to the bottle neck 16 to be affixed thereto by the act of applying the screw cap to the container.

Figure 3:
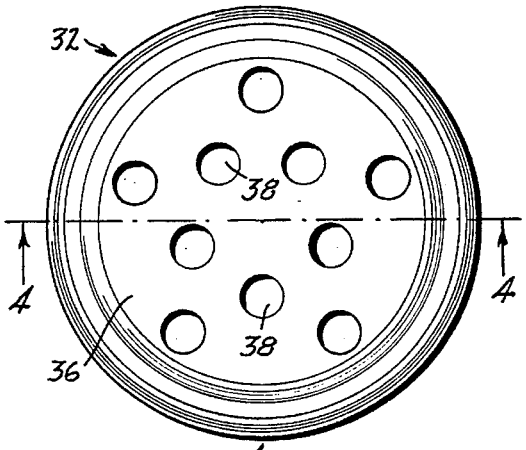
FIG. 3 is a top plan view of the resilient plastic sifter member of the container, according to the invention.
Figure 4:
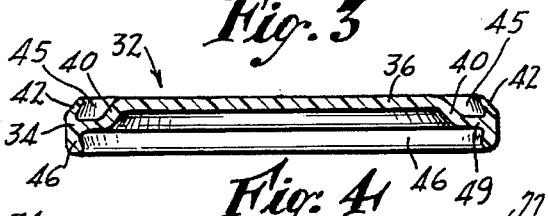
FIG. 4 is a diametric section of the sifter member, taken on the line 4—4 of FIG. 3.

In effecting this, the invention provides a novel resilient plastic sifter or sifter member 32, FIGS. 3 and 4, and cooperable separable and yieldable interlocking attachment means on the member 32 and screw cap 22 by which the sifter member 32 is initially yieldably mounted in the screw cap 22. The sifter member 32 as shown in FIGS. 3 and 4, comprises a generally disk-like part having a peripheral annular band-like rim 34 which is spanned by a circular apertured center sifter or wall portion 36 having an upwardly crowned inner portion provided with sifter holes 38. The wall portion 36 is in the form of a raised plateau, being connected to the rim portion 34 by an annular shoulder 40 and closely fitting against the closure wall 24 of the cap to effect a seal thereto.

Figure 6:
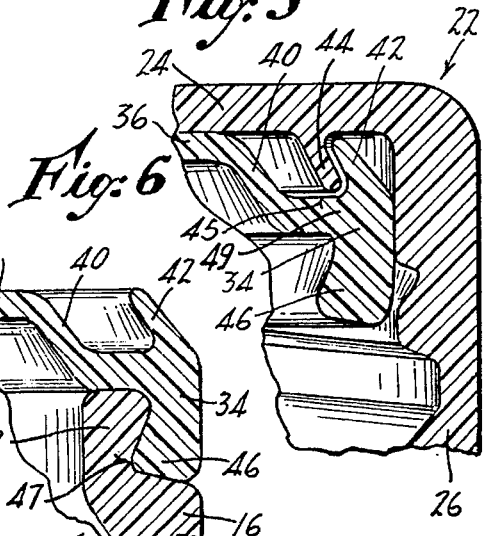
FIG. 6 is a greatly enlarged fragmentary corner sectional view of an interlocked assemblage of the screw cap and sifter members of the container means. The figure shows a space between interlocked beads of the cap and sifter member. As presently understood, such interlocked beads may in some cases engage one another, or forcibly touch each other.

In accordance with the present invention, the band-like rim 34 comprises upper and lower back-to-back resilient and yieldable annular attachment beads 42, 46 respectively. The bead 42 is cooperable with a depending integrally molded outwardly flared bead 44 on the underside of the screw cap 22. The beads 42 and 44 interlock with each other with an interference fit, as seen in FIGS. 1 and 6, thereby yieldably holding the sifter member 32 firmly in the screw cap 22 and forming a unitary assemblage which can be transported to the packaging facility and fed either automatically or by hand to the packaging machine which mounts it on the container and torques it into sealing position.

The center portion 36 is joined to the rim 34 at a circular zone 49 that is intermediate the upper and lower edges of the rim. The outer surface of the bead 42 is conical, and the outer surface of the bead 46 is substantially cylindrical, such outer surfaces smoothly merging with each other at the zone 49 of the rim. The upper and lower beads of the sifter member together form a continuous annular exterior surface of the rim, and have a generally obtuse angular relationship.

Figure 7:
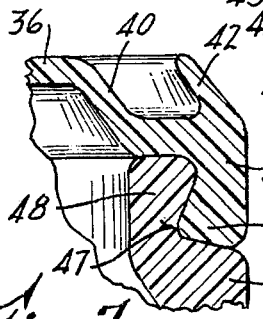
FIG. 7 is a view like that of FIG. 6, but of the stretched sifter member and neck of the container or bottle.

The annular shoulder 40 and bead 42 of the sifter member 32 constitute opposite walls of an annular groove 45 which receives the annular bead 44 of the screw cap 22. Further, the bead 46 is cooperable with a companion lip portion 48 of the bottle neck 16. Between the container lip 48 and adjacent portions of the neck 16 is an annular groove or external undercut 47 of generally V-section. These interactions are clearly shown in FIGS. 6 and 7, in enlarged views.

The unique action of the present improved cap and sifter assemblage can be more easily explained with reference to the drawing figures. Considering FIGS. 1 and 4–7, the various portions of the sifter member 32 when applied to the container 10 are stretched in a radially outward direction, including stretching at the yieldable band-like rim 34 as a consequence of the container lip 48 being slightly larger than the lower bead 46. According to the invention, this stretching reduces the retention of the interlock between the beads 42 and 44 respectively on the member 32 and cap 22. This facilitates a by-pass of these beads 42, 44 whenever the screw cap 22 is unscrewed from the container 10. The result is an easier and more reliable separation of the cap 22 from the sifter member 32 and container. In other words, the stretched sifter member 32 while still on the container 10 is more inclined to release the cap 22 due to the action of container lip 48. In consequence, there is eliminated any inadvertent lifting off of the sifter with the screw cap 22 whenever the latter is subsequently removed from the container. This improved retention of the sifter member 32 on the container 10 as occasioned by the weakened retentive force between the cap 22 and sifter member 32 is an important feature of the present invention.

The firm hold or retention produced by the undercut configurations of the beads 46, 48 of the sifter member and the bottle lip 48, in combination with the reduced retention between the beads 42, 44 noted in the previous paragraph, minimize any tendency for separation at all times that the screw cap 22 is being unscrewed from the bottle 10.

Stated differently, prior to application of the cap to the bottle, the beads 42 and 44 provide an effective predetermined retention force which holds the sifter member 32 in place in the screw cap. Releasing of the sifter member from the cap can be effected only in response to the application to the sifter member of a separating force which is of greater magnitude than this retention force. However, following initial assembly of the cap on the bottle 10, the bottle lip 48 now comes into play regarding future removal of the screw cap 22. The bottle lip 48 firmly grasps the sifter member 32 and in so doing it tends to spread apart or enlarge the rim 34. As a consequence, the holding force which retains the sifter member 32 on the container 1 is now always stronger than the retention force between the sifter member and the screw cap, such that all subsequent removals of the screw cap from the container will reliably leave the sifter member in place, locked on the container.

A further action in this connection should be noted. Considering the sifter member 32 per se, the wall 36 thereof tends to resist expansion of the peripheral band-like rim 34, as well as the beads 42, 46. After the assemblage of the screw cap 22 and sifter member 32 is applied to the container, the rim or lip portion 48 (FIG. 7) thereof forces the bead 46 radially outward and this stretches the sifter wall 36 to an extent. Because the stretched sifter wall 36 no longer exerts the same strong initial influence on the bead 42, but instead now exerts a lesser restraint, the bead 42 can yield outward more easily, resulting in facilitating the by-pass of the beads 44 and 42.

The above retention-release action of the cap-sifter assemblage is also facilitated by the relative thicknesses of the beads 42 and 46. The bead 46 is thicker than the bead 42, being more than twice the thickness as shown. Also, the beads 42 and 46 are substantially of the same height. In addition, the bead 42 tapers to a thinner edge at its top, whereas the bead 46 diverges to a thicker edge at its bottom. All of the above constitute factors to varying degrees in the retention-release action of the assemblage.

As presently understood, under some circumstances the beads 42, 44 will be mostly touching as shown in FIG. 1; there is also the possibility diagrammatically illustrated in FIG. 6, by which a small space between the beads 42 and 44 is seen to exist at some areas around the periphery.

Thus, in summarizing, the force required to effect separation of the sifter member 32 from the screw cap 22 becomes reduced as a consequence of the stretching of the upper attachment bead 42 of the sifter member as effected by the radially outward force of the container lip 48 on the lower attachment bead 46 of the sifter member.

Figure 5:
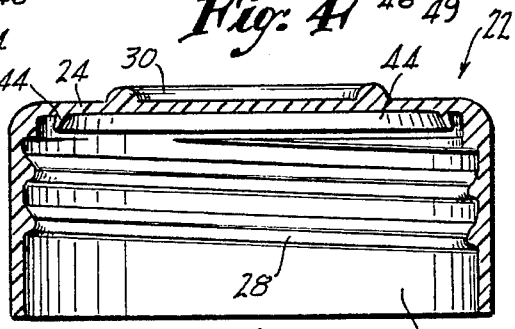
FIG. 5 is an axial sectional view of the resilient plastic screw cap member of the container.

In FIGS. 5 and 6, it can be seen that in a preferred form, the bead 42 can be wider at its base than at its crest, the same being true of the bead 46. Tolerance considerations are, as presently understood, taken into account in determining the actual degree of taper in the bead cross sections that are depicted.

It will be seen from the foregoing that we have provided an improved packaging concept involving a sifter member which is temporarily yieldably held in a screw cap, for use on a container, wherein an automatic transfer of the sifter to the container is effected by the first or initial capping operation so as to be then permanently retained on the container for all subsequent use of the latter. The accomplishment of this objective is especially simple, involving few and inexpensive components, being at the same time reliable in operation and especially labor-saving and cost-effective.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A closure and sifter assemblage for use with a container having a lip with an external undercut, comprising in combination:

a) a screw cap having a threaded skirt and a closure wall spanning said skirt, and b) transferrable sifter means in said screw cap, comprising a sifter member having a central apertured portion spanning the skirt of the screw cap, c) said sifter member comprising a peripheral annular band-like rim having upper and lower back-to-back yieldable annular attachment beads, d) said closure wall of the screw cap having an integrally molded radially outwardly extending annular bead disposed adjacent to and lying radially inwardly of said skirt of the cap, e) said upper bead of the sifter member, when the latter is assembled to the screw cap, resiliently and releasably interlocking with an interference fit to the said annular bead of the screw cap, f) said lower attachment bead of the sifter member being frictionally engageable with said external undercut in the lip of the container when the screw cap and sifter member are screwed onto the container, g) said container lip being sized to effect a radially outward stretching of the band-like rim of the sifter member through contact with said lower attachment bead of the sifter member and a corresponding radially outward stretching of the said upper yieldable attachment bead thereof thereby to reduce the interference fit existing between said upper attachment bead of the sifter member and the bead of the screw cap so as to facilitate by-pass of said beads whenever the screw cap is removed, with the end result that the sifter member is thereafter always left in position on the lip of the container upon complete removal of the screw cap from the container.

2. A closure and sifter assemblage according to claim 1, wherein:

a) the sifter member has an upwardly crowned, apertured central portion engageable with the closure wall of the cap.

3. A closure and sifter assemblage according to claim 1, wherein:

a) said screw cap has an annular reinforcing rib on the exterior of its closure wall.

4. A closure and sifter assemblage according to claim 1, wherein:

a) the upper bead on the sifter member is wide at its base and narrower at its crest.

5. A closure and sifter assemblage according to claim 1, wherein:

a) the lower bead on the sifter member is narrower at its base and thicker at its crest.

6. A closure and sifter assemblage according to claim 1, wherein:

a) said upper and lower beads of the sifter member together form a continuous annular exterior surface of said rim, and have a generally obtuse angular configuration.

7. A closure and sifter assemblage according to claim 1, wherein:

a) a portion of the rim constituted by the lower bead has a generally cylindrical configuration, and b) another portion of the rim constituted by the upper bead has a generally conical configuration.

8. A closure and sifter assemblage according to claim 1, wherein:

a) the central apertured portion of the sifter member connects to its band-like rim along a zone which is between the upper and lower attachment beads of the sifter rim.

9. A closure and sifter assemblage according to claim 1, wherein:

a) the lower attachment bead of the sifter member is thicker than the upper attachment bead.

10. A closure and sifter assemblage according to claim 9, wherein:

a) the lower attachment bead of the sifter member is more than twice the thickness of the upper attachment bead thereof.

11. A closure and sifter assemblage according to claim 1, wherein:

a) the attachment beads of the sifter member are of substantially the same height.

* * * * *